US008833027B2

(12) United States Patent
Trower et al.

(10) Patent No.: US 8,833,027 B2
(45) Date of Patent: Sep. 16, 2014

(54) BUILDING PANEL

(76) Inventors: Stephen John Trower, Iluka (AU); Steven John Bedford, Scarborough (AU)

( * ) Notice: Subject to any disclaimer, the term of this patent is extended or adjusted under 35 U.S.C. 154(b) by 184 days.

(21) Appl. No.: 12/825,814

(22) Filed: Jun. 29, 2010

(65) Prior Publication Data

US 2010/0325991 A1 Dec. 30, 2010

Related U.S. Application Data

(63) Continuation-in-part of application No. PCT/AU2009/000644, filed on May 22, 2009.

(30) Foreign Application Priority Data

Nov. 16, 2009 (AU) ..... 2009238283

(51) Int. Cl.

| | |
|---|---|
| ***E04B 2/00*** | (2006.01) |
| ***E04C 1/00*** | (2006.01) |
| ***E04D 3/28*** | (2006.01) |
| ***E04C 2/54*** | (2006.01) |
| *E04D 3/362* | (2006.01) |
| *E04D 3/35* | (2006.01) |

(52) U.S. Cl.

CPC ..... *E04C 2/546* (2013.01); *E04D 3/362* (2013.01); *E04D 3/357* (2013.01); *E04D 3/28* (2013.01); *E04D 2003/285* (2013.01)

USPC ..... 52/588.1; 52/309.1; 52/582.1

(58) Field of Classification Search

CPC ..... E04D 3/24; E04D 3/32; E04D 3/35; E04D 3/351; E04D 3/352; E04D 3/357; E04D 3/361; E04D 3/362; E04D 3/363; E04D 3/366; E04D 3/368; E04F 15/10; E04F 15/105; E04C 2/20

USPC ..... 52/536, 537, 586, 478, 588.1, 519, 526, 52/539, 541, 544, 592.1, 520, 586.2, 52/583.1–592.6, 650.3, 309.1, 783.1, 52/582.1

See application file for complete search history.

(56) References Cited

U.S. PATENT DOCUMENTS 3,815,311 A * 6/1974 Nisula et al. ..... 52/579
3,886,705 A * 6/1975 Cornland ..... 52/588.1

(Continued)

FOREIGN PATENT DOCUMENTS

GB 1 272 729 5/1972
GB 1 511 189 5/1978

(Continued)

OTHER PUBLICATIONS

International Search Report mailed Jul. 22, 2009.

*Primary Examiner* — Basil Katcheves
*Assistant Examiner* — Theodore Adamos
(74) *Attorney, Agent, or Firm* — Nixon & Vanderhye P.C.

(57) ABSTRACT

A building panel having a hollow elongate structure with a generally rectangular cross-sectional profile. The elongate structure has first and second outer skins joined by parallel first and second side walls. A connection device of first and second ribs is on each side wall to connect to adjacent panels to form a segment of a wall or roof. The elongate structure includes two inner web skins extending between the first and second side walls to divide the interior of the elongate structure into three chambers. The triple chamber profile provides the panel with additional structural strength and rigidity, as well as improved thermal and sound insulation properties. The lower chamber may be fitted with a polycarbonate sheet to increase thermal and acoustic performance. The panel is polycarbonate.

28 Claims, 9 Drawing Sheets

(56) References Cited

U.S. PATENT DOCUMENTS

| | | | | | |
|---|---|---|---|---|---|
| 4,186,539 | A * | 2/1980 | Harmon et al. | 52/580 |
| 4,441,291 | A * | 4/1984 | Sokoler et al. | 52/309.1 |
| 4,509,306 | A * | 4/1985 | Sokoler et al. | 52/302.7 |
| 4,580,373 | A * | 4/1986 | Bastiansen et al. | 52/94 |
| 4,602,853 | A * | 7/1986 | Barr | 359/852 |
| 5,411,782 | A * | 5/1995 | Jarvis et al. | 428/57 |
| 5,448,865 | A * | 9/1995 | Palmersten | 52/309.9 |
| 5,636,481 | A * | 6/1997 | De Zen | 52/95 |
| 5,966,888 | A * | 10/1999 | Richardson | 52/580 |
| 6,085,485 | A * | 7/2000 | Murdock | 52/783.19 |
| 6,161,356 | A * | 12/2000 | Richardson | 52/586.2 |
| 6,167,669 | B1 * | 1/2001 | Lanc | 52/426 |
| 6,189,269 | B1 * | 2/2001 | De Zen | 52/220.5 |
| 6,212,845 | B1 * | 4/2001 | De Zen | 52/607 |
| 6,298,627 | B1 * | 10/2001 | Richardson | 52/582.1 |
| 6,314,701 | B1 * | 11/2001 | Meyerson | 52/588.1 |
| 6,792,730 | B2 * | 9/2004 | Richardson | 52/586.2 |
| 6,834,468 | B1 * | 12/2004 | Kroie | 52/590.2 |
| 7,047,697 | B1 * | 5/2006 | Heath | 52/177 |
| 7,069,701 | B2 * | 7/2006 | Chen | 52/580 |
| 7,513,081 | B2 * | 4/2009 | Armstrong | 52/79.1 |
| 7,628,000 | B2 * | 12/2009 | Kahl | 52/588.1 |
| 8,037,654 | B2 * | 10/2011 | Hanya et al. | 52/579 |
| 2005/0284074 | A1 * | 12/2005 | Armstrong | 52/588.1 |
| 2006/0096211 | A1 * | 5/2006 | Verheyen | 52/408 |
| 2008/0148673 | A1 * | 6/2008 | Keller | 52/592.1 |

FOREIGN PATENT DOCUMENTS

| | | | | |
|---|---|---|---|---|
| GB | 1 528 874 | | 10/1978 | |
| GB | 2 243 170 | | 10/1991 | |
| WO | PCT/AU2009/000644 | * | 5/2009 | E04D 3/32 |
| WO | WO 2010132916 A1 | * | 11/2010 | |

* cited by examiner

BUILDING PANEL

This application is a continuation-in-part (CIP) of International Application No. PCT/AU2009/000644 filed 22 May 2009 which designated the U.S. and this CIP application also claims priority to AU 2009238283 filed 16 Nov. 2009, the entire contents of each of which applications are hereby incorporated by reference in their entirety.

FIELD OF THE INVENTION

The present invention relates to a building panel and a building system and relates particularly, though not exclusively, to a polycarbonate roofing or wall panel.

BACKGROUND TO THE INVENTION

Polycarbonate roofing panels are well known in the building and construction arts. They are relatively lightweight, strong and translucent, providing a passive form of solar heating and lighting. They are used in domestic, industrial and commercial building applications. Prior art polycarbonate roofing panels are supplied in varying thicknesses up to 30 mm, and up to 6 m in length. For some specialized applications they can be purchased up to 12 m in length. However all prior art polycarbonate sheeting requires additional steelwork for support, and this introduces undesirable aesthetic constraints from an architectural and design perspective.

The present invention was developed with a view to providing a building panel and system which fills a gap in the building and construction industry, namely, a cost-effective polycarbonate system with long span capability. However it will be apparent that the building panels can also be manufactured from suitable materials other than polycarbonate.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a polycarbonate building panel for the construction industry, the panel comprising:

a hollow elongate structure having a generally rectangular cross-sectional profile, the elongate structure comprising a first upper outer skin and a second substantially planar lower outer skin joined by first and second side walls; and connecting means provided on each side wall respectively wherein, in use, adjacent panels can be connected to each other side by side with the connecting means to form a segment of a wall or roof, wherein the connecting means each comprise a first rib and a second rib, the first rib being adapted to engage with a matching rib on an adjacent panel and the second rib also being adapted to engage with a matching rib on the adjacent panel, and wherein the second rib on each side wall has a rectangular profile with a lower wall and an outer wall forming a channel, the second rib on one side wall being formed with a recess adjacent thereto which is adapted to accommodate an outer wall of the second rib on the other side wall of an adjacent panel to provide an interlocking relationship, and wherein the lower wall of the second rib on the other side wall is substantially aligned with a lower outer skin of the elongate structure so as to form a substantially seamless planar lower surface of the panel when adjacent panels are connected.

Preferably the upper outer skin of the elongate structure has a degree of outward curvature in profile so as to form a convex outer surface. The convex upper outer surface advantageously gives the panel a self-cleaning ability wherein dust and other contaminants simply run-off the outer convex surface when wetted. Preferably the first and second side walls are substantially parallel. Typically the first and second side walls are substantially planar.

Preferably the elongate structure comprises a third inner skin in the form of a web extending between the first and second side walls so as to divide the interior of the elongate structure into two chambers. The dual chamber profile of the elongate structure provides structural strength and rigidity, as well as improved thermal and sound insulation properties.

The elongate structure may comprise a fourth inner skin in the form of a web extending between the first and second side walls so as to divide the interior of the elongate structure into three chambers. One or more of the chambers may be filled with additional materials to enhance the structural strength and/or thermal and/or sound insulation properties of the panel.

Preferably the matching ribs on an adjacent panel have a matching profile and are received in a nested engagement with the respective first and second ribs when adjacent panels are connected to each other side by side with the connecting means. Advantageously the nested engagement of the ribs together with the respective side walls of the adjacent panels form an enclosed chamber between the adjacent panels.

Preferably an elongate locking member is received in the enclosed chamber to lock the ribs into nested engagement with each other wherein, in use, adjacent panels are locked together to form a segment of a wall or roof.

Advantageously the hollow elongate structure is manufactured from extruded polycarbonate. Preferably the outer skins and side walls of the elongate structure are between 1 mm to 2.5 mm thick. Typically the upper outer skin is between 1.2 mm to 2.0 mm thick. Typically the lower outer skin is between 1.4 mm to 1.8 mm thick. Preferably the upper outer skin has a UV resistant layer applied to it. Typically the UV resistant layer has a minimum thickness of 0.050 mm.

Preferably the total thickness of the polycarbonate panel is between 65 mm to 90 mm. More typically the total thickness of the polycarbonate panel is between 73 mm to 76 mm. A preferred embodiment of the polycarbonate panel is about 74 mm thick. Preferably the total width of the polycarbonate panel is between 80 mm to 120 mm. More typically the total width of the polycarbonate panel is between 95 mm to 110 mm. A preferred embodiment of the polycarbonate panel is about 100 mm wide.

In one form of the panel the elongate structure is substantially planar. In another form of the panel the elongate structure is formed with a degree of longitudinal curvature to give the panel increased load-bearing capacity.

According to another aspect of the present invention there is provided a polycarbonate building system for the construction industry, the system comprising:

a plurality of polycarbonate building panels, each panel comprising:

a hollow elongate structure having a generally rectangular cross-sectional profile, the elongate structure comprising a first upper outer skin and a second substantially planar lower outer skin joined by first and second side walls; and connecting means provided on each side wall respectively wherein, in use, adjacent panels can be connected to each other side by side with the connecting means to form a segment of a wall or roof, wherein the connecting means each comprise a first rib and a second rib, the first rib being adapted to engage with a matching rib on an adjacent panel and the second rib also being adapted to engage with a matching rib on the adjacent panel, and wherein the second rib on each side wall has a rectangular profile with a lower wall and an outer wall forming a channel, the second rib on one side wall being formed with a recess adjacent thereto which is adapted to accommodate an outer wall of the second rib on the other side wall of an adjacent panel to provide an interlocking relationship, and wherein the lower wall of the second rib on the other side wall is substantially aligned with a lower outer skin of the elongate structure so as to form a substantially seamless planar lower surface of the panel when adjacent panels are connected;

wherein, in use, the plurality of panels can be joined to each other side by side with the connecting means to form a segment of a wall or roof.

Preferably the polycarbonate building system further comprises an elongate locking member adapted to engage with the connecting means to join adjacent panels to each other side by side. In one embodiment the locking member is in the form of an extruded aluminum bar. In another embodiment the locking member is in the form of an extruded polycarbonate bar.

Preferably the polycarbonate building system further comprises an end cap adapted to be received in the hollow end of the elongate structure. Advantageously the end cap has first and second spigot pieces adapted to be received in the two chambers of the hollow elongate structure.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of preferred embodiments of the building panel and building system, given by way of example only, with reference to the accompanying drawings, in which:

FIG. 2(*b*) is a section view showing a second embodiment of the manner of joining adjacent panels together side by side;

FIG. 8(*b*) is a section view showing a second embodiment of the manner of joining adjacent panels of FIG. 7*a* or 7*b* together side by side;

DETAILED DESCRIPTION OF PREFERRED EMBODIMENTS

Figure 1:
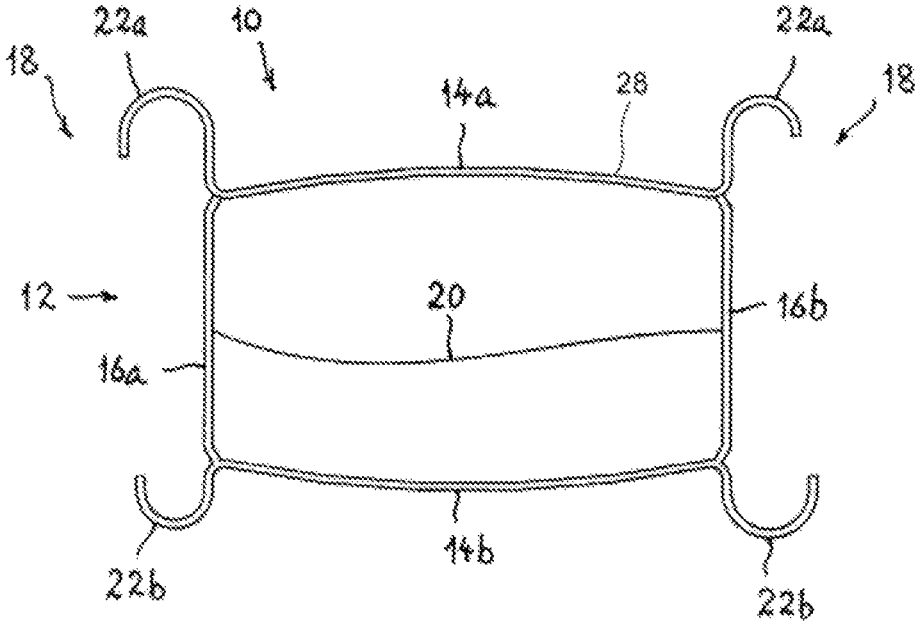
FIG. 1 is a section view through a first preferred embodiment of the building panel according to the present invention.
Figure 2A:
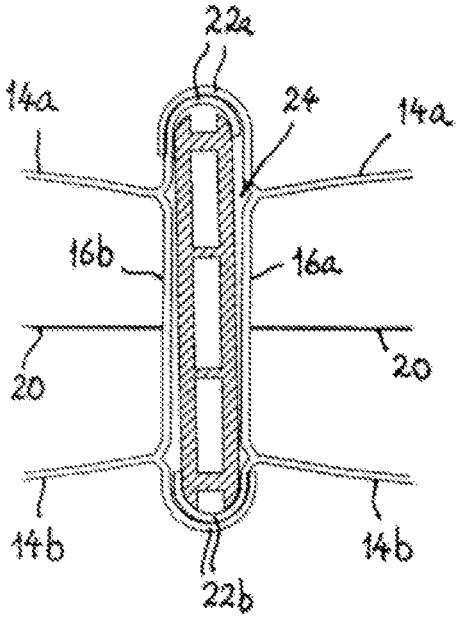
FIG. 2(*a*) is a section view showing a first embodiment of the manner of joining adjacent panels together side by side.
Figure 2B:
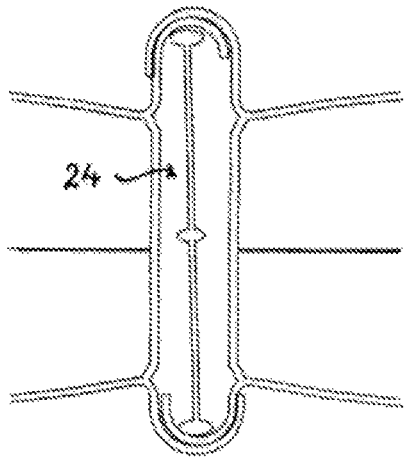
Figure 3:
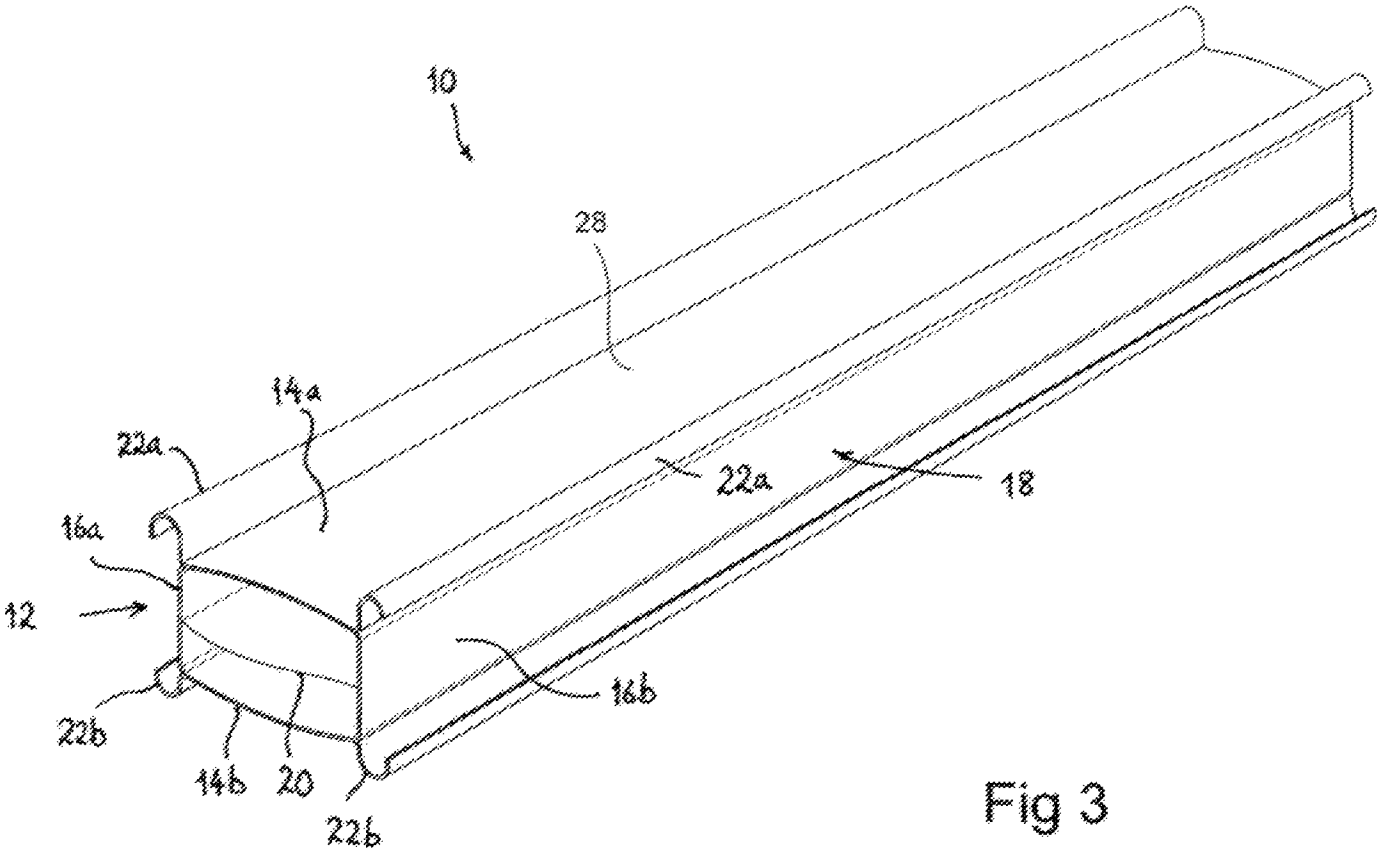
FIG. 3 is a top perspective view of the panel of FIG. 1.

A first preferred embodiment of the building panel 10 as shown in FIGS. 1 to 4 comprises a hollow elongate structure 12 having a generally rectangular cross-sectional profile as can be seen most clearly in FIG. 1. The elongate structure 12 comprises first and second outer skins 14*a* and 14*b* joined by substantially parallel first and second side walls 16*a* and 16*b*. The outer skins 14 of the elongate structure 12 preferably have a degree of outward curvature in profile so as to form convex outer surfaces. The convex outer surfaces advantageously give the panel 10 a self-cleaning capability wherein dust and other contaminants simply run-off the outer convex surfaces when wetted. The building panel is preferably made of polycarbonate.

Figure 4:
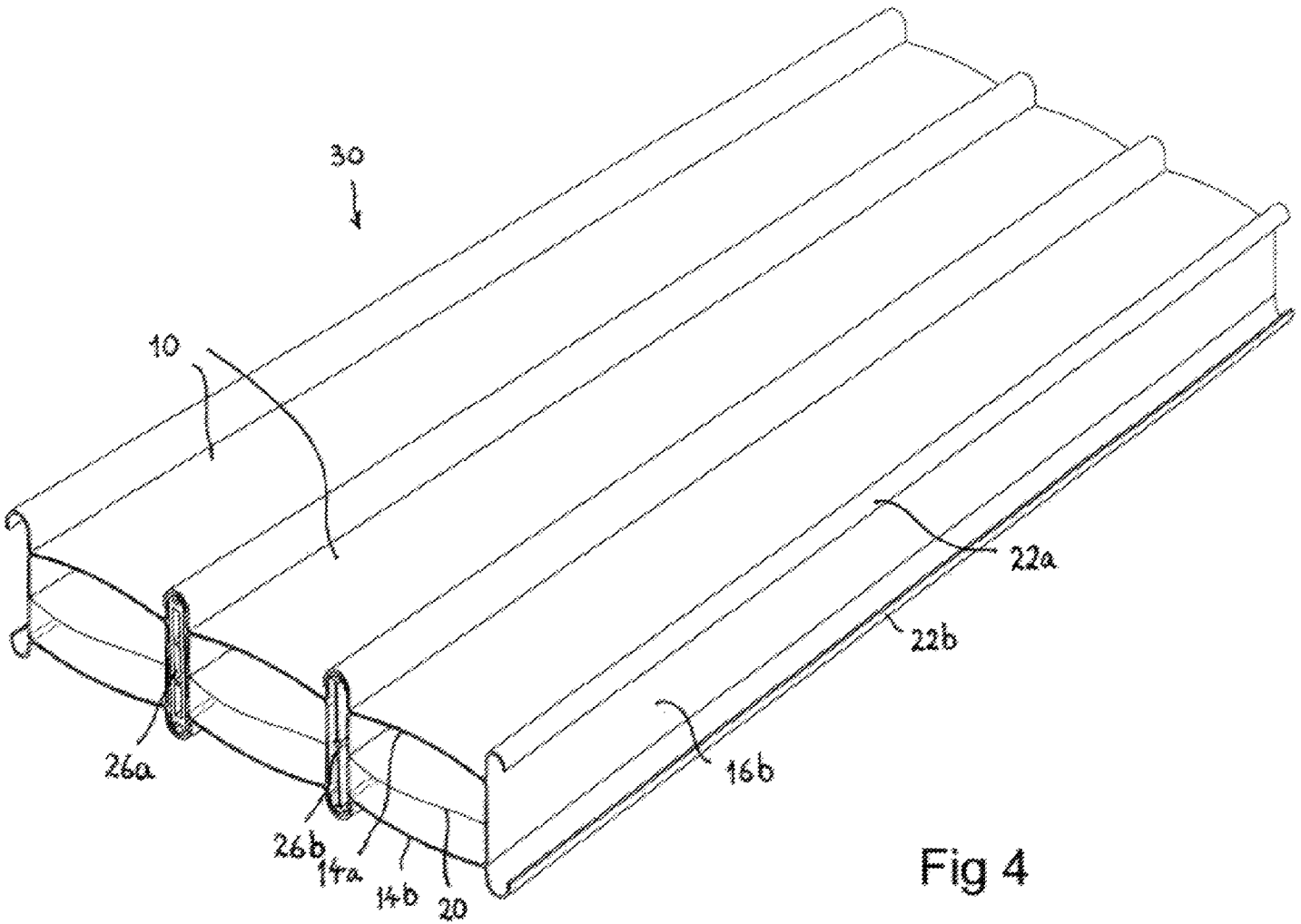
FIG. 4 is a top perspective view showing a plurality of the panels of FIGS. 1 and 3 joined together side by side.

The panel 10 further comprises a connecting means 18 provided on each side wall 16 respectively wherein, in use, adjacent panels 10 can be connected to each other side by side with the connecting means 18 to form a segment of a wall or roof, as shown in FIG. 4. The panels 10 are primarily designed for use as roofing panels, however in view of their structural strength and rigidity it will be understood that they can also be used in a variety of other ways for constructing a building, including wall panels.

Preferably the elongate structure 12 comprises a third inner skin in the form of a web 20 extending between the first and second side walls 16 so as to divide the interior of the elongate structure into two chambers. The dual chamber profile of the elongate structure 12 provides the panel 10 with additional structural strength and rigidity, as well as improved thermal and sound insulation properties.

Preferably the connecting means 18 each comprise a first rib 22*a* and a second rib 22*b*. The first rib 22*a* is adapted to engage with a matching rib 22*a* on an adjacent panel, and the second rib 22*b* is also adapted to engage with a matching rib 22*b* on the adjacent panel (see FIG. 2). In this embodiment the first and second ribs 22 each have a curved profile and are arranged with concave surfaces facing each other. In the present case the ribs 22 have a semicircular profile, however it will be understood that a variety of profiles would work.

As can be seen most clearly in FIG. 1, the ribs 22 together with the side wall 16 form a cavity. Preferably the matching ribs 22*a* and 22*b* on an adjacent panel have a matching curvature and are received in a nested engagement with the respective first and second ribs 22*a* and 22*b* when adjacent panels are connected to each other side by side with the connecting means (see FIG. 2). The inside diameter of the first rib 22*a* is approximately equal to the outer diameter of the matching rib 22*a*, and the outside diameter of the rib 22*b* is approximately equal to the inside diameter of the matching rib 22*b*, in order to facilitate their nested engagement. Advantageously the nested engagement of the ribs 22 together with the respective side walls 16 of the adjacent panels 10 form an enclosed cavity 24 between the adjacent panels.

Figure 5:
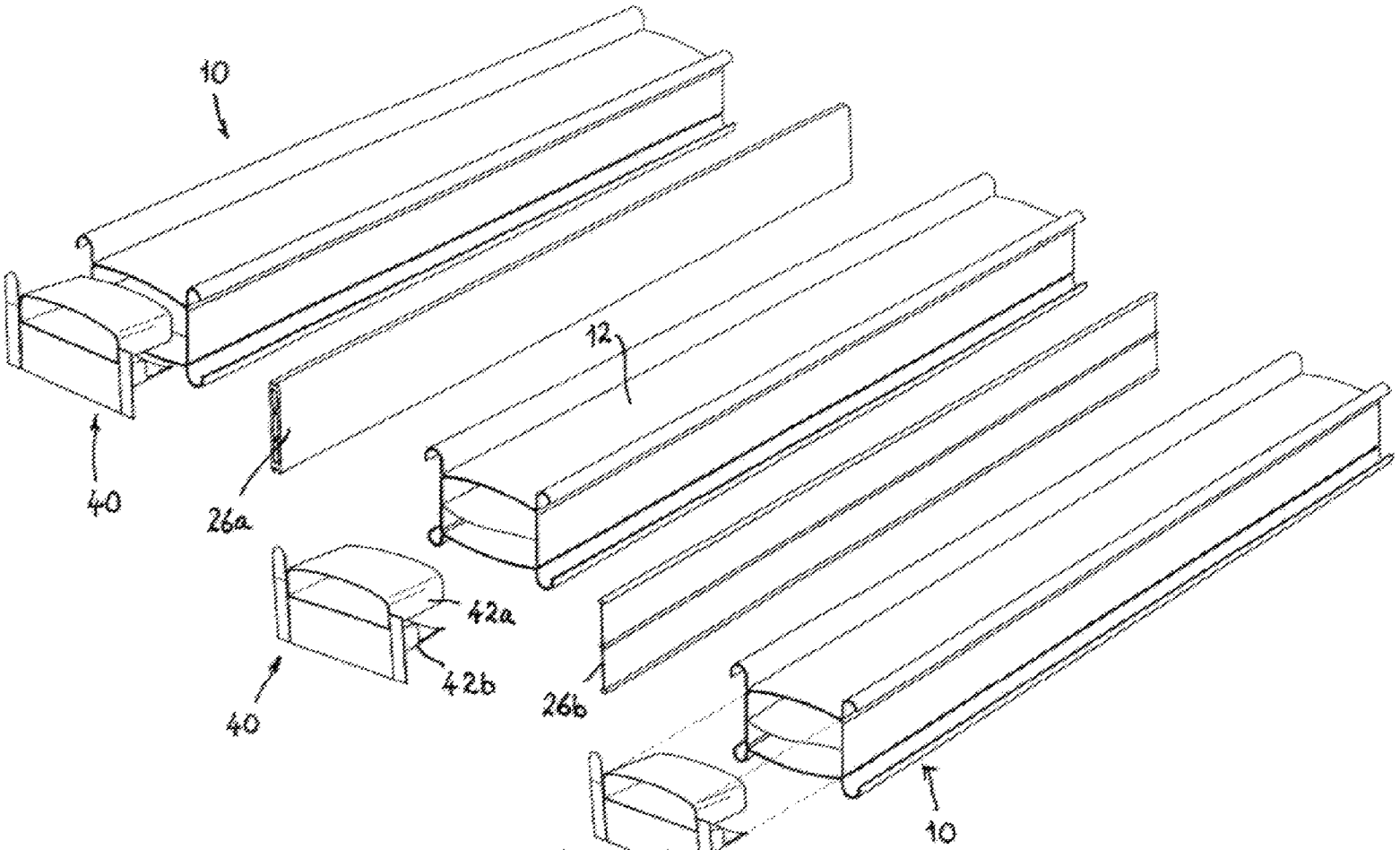
FIG. 5 is an exploded top perspective view of the panels in FIG. 4.

Preferably an elongate locking member 26 is received in the enclosed cavity 24 to lock the ribs 22 into nested engagement with each other. In this manner adjacent panels 10 are locked together to form a segment of a wall or roof. One of the purposes of the locking bars 26 is to absorb upwardly directed wind pressure. FIG. 4 illustrates a roof segment of a wall segment 30 formed from a plurality of the panels 10 connected to each other side by side with the connecting means 18. Two types of locking member 26 are provided (see also FIG. 5). A first locking member 26*a* is made from extruded aluminum and gives the roof segment increased strength and rigidity. A second locking member 26*b* is made from extruded polycarbonate. Both locking members 26 are typically inserted manually during the assembly process. Preferably the ribs 22 are sealed in their nested engagement using a butyl rubber mastic sealant.

In one form of the panel 10 the elongate structure 12 is substantially planar. In another form of the panel 10 (not illustrated) the elongate structure 12 is formed with a degree of longitudinal curvature to give the panel increased load-bearing capacity. The locking members 26 may likewise be curved so as to be received in the enclosed cavities 24 between the panels. The panels 10 can be pre-curved during the manufacturing process. When the panels 10 have been assembled they are placed on a bending table which slides directly into the oven for a specified time period. The angle of curvature of the bending table is preset to correspond to the desired shape of the roof. After this process the panels are left to cool and on larger spans curved aluminum locking bars 26 are inserted. This then forms the specified curvature of the panels. The completed panels can then be delivered to site. Installation of the panels is identical to flat applications; polycarbonate locking bars 26 are inserted, which simply lock the panels together.

A typical roof bay comprises six of the panels 10 connected side by side (two of the roof segments 30 of FIG. 4 connected side by side). Various combinations of locking members 26*a* and 26*b* may be employed to attain different structural strength capabilities for the roof bay. The loading combinations are as follows:

| Flat panels | |
|---|---|
| Lock Specification (LS) | Max free span |
| 1 | 2.61 metre |
| 2.1 | 3.18 metre |
| 2.2 | 3.62 metre |
| 2.5 | 4.38 metre |

| Curved panels | | | | |
|---|---|---|---|---|
| Lock Specification (LS) | Free span 20 degrees | Free span 25 degrees | Free span 30 degrees | Free span 35 degrees |
| 1 | 6.05 metre | 6.43 metre | 6.72 metre | 6.93 metre |
| 2.1 | 8.00 metre | 8.50 metre | 8.88 metre | 9.16 metre |
| 2.2 | 9.49 metre | 10.08 metre | 10.53 metre | 10.86 metre |
| 2.5 | 11.36 metre | 12.07 metre | 12.24 metre | 12.00 metre |

LS1=6 polycarbonate locking bars in a six panel bay
LS2.1=1 aluminum locking bar+5 polycarbonate bars in a six panel bay
LS2.2=2 aluminum locking bars+4 polycarbonate bars in a six panel bay
LS2.5=5 aluminum locking bars and 1 polycarbonate bar in a six panel bay The Locking System weight and dead load specifications are as follows:
LS1 weight=7 kg/sqm. Dead load 0.078 kN/sqm.
LS2.1 weight=9 kg/sqm. Dead load 0.091 kN/sqm.
LS2.2 weight=10 kg/sqm. Dead load 0.101 kN/sqm.
LS2.5 weight=14 kg/sqm. Dead load 0.142 kN/sqm.

Advantageously the hollow elongate structure 12 is manufactured from extruded polycarbonate. Preferably the outer skins 14 and side walls 16 of the elongate structure 12 are between 1 mm to 2.5 mm thick. Preferably the upper outer skin 14*a* is slightly thicker than the lower outer skin 14*b*. Typically the upper outer skin 14*a* is between 1.2 mm to 2.0 mm thick. Typically the lower outer skin 14*b* is between 1.4 mm to 1.8 mm thick. Preferably the upper outer skin 14*a* has a UV resistant layer 28 applied to it. Typically the UV resistant layer 28 has a minimum thickness of 0.050 mm.

Preferably the total thickness of the polycarbonate panel 10 is between 65 mm to 90 mm. More typically the total thickness of the polycarbonate panel 10 is between 73 mm to 76 mm. A preferred embodiment of the polycarbonate panel 10 is about 74 mm thick. Preferably the total width of the polycarbonate panel 10 is between 80 mm to 120 mm. More typically the total width of the polycarbonate panel 10 is between 95 mm to 110 mm. A preferred embodiment of the polycarbonate panel 10 is about 100 mm wide.

Figure 6:
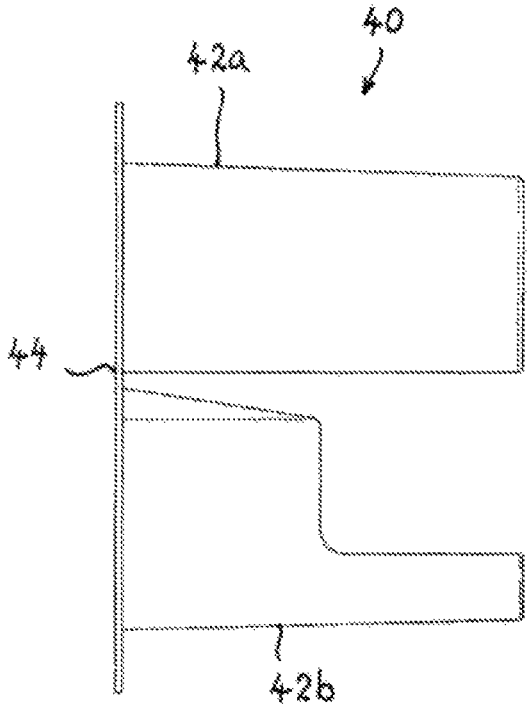
FIG. 6 is a side elevation of a preferred embodiment of an end cap for the building panel of FIG. 1.

Preferably the building panel 10 further comprises an end cap 40 adapted to be received in the hollow end of the elongate structure 12. Advantageously the end cap 40 has first and second spigot pieces 42*a* and 42*b* adapted to be received in the two chambers of the hollow elongate structure 12. As can be seen most clearly in FIG. 6, the end cap 40 has a planar front face 44, on the back of which the spigot pieces 42 are formed. The first spigot piece 42*a* opens onto the front face 44, and forms a handhold which can be grasped to insert the end cap 40 into the end of the hollow elongate structure 12 (see FIG. 5).

Figure 7A:
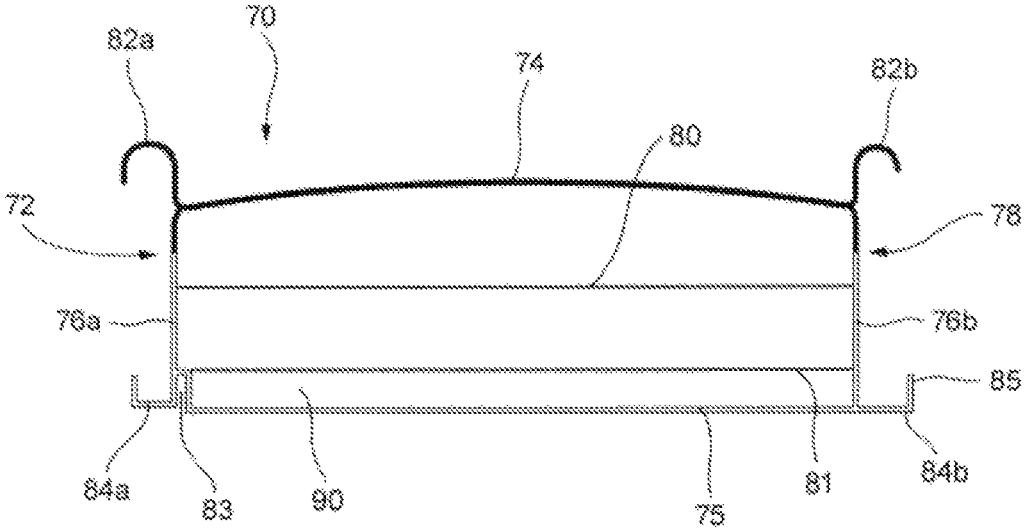
FIGS. 7(*a*) and 7(*b*) are section views through second and third preferred embodiments respectively of the building panel according to the present invention.
Figure 7B:
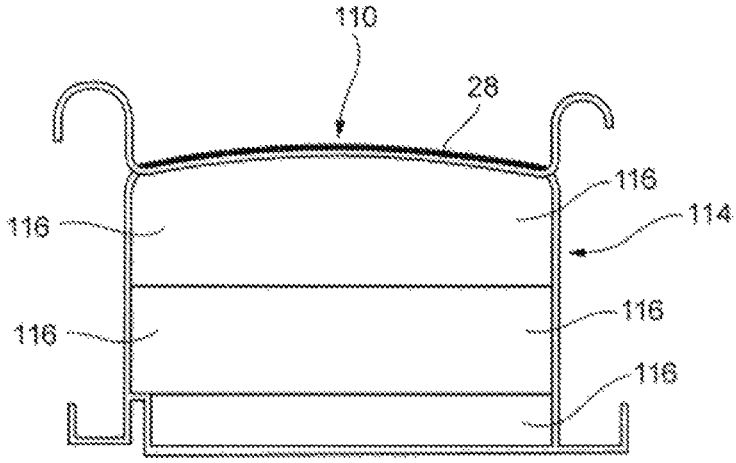
Figure 8A:
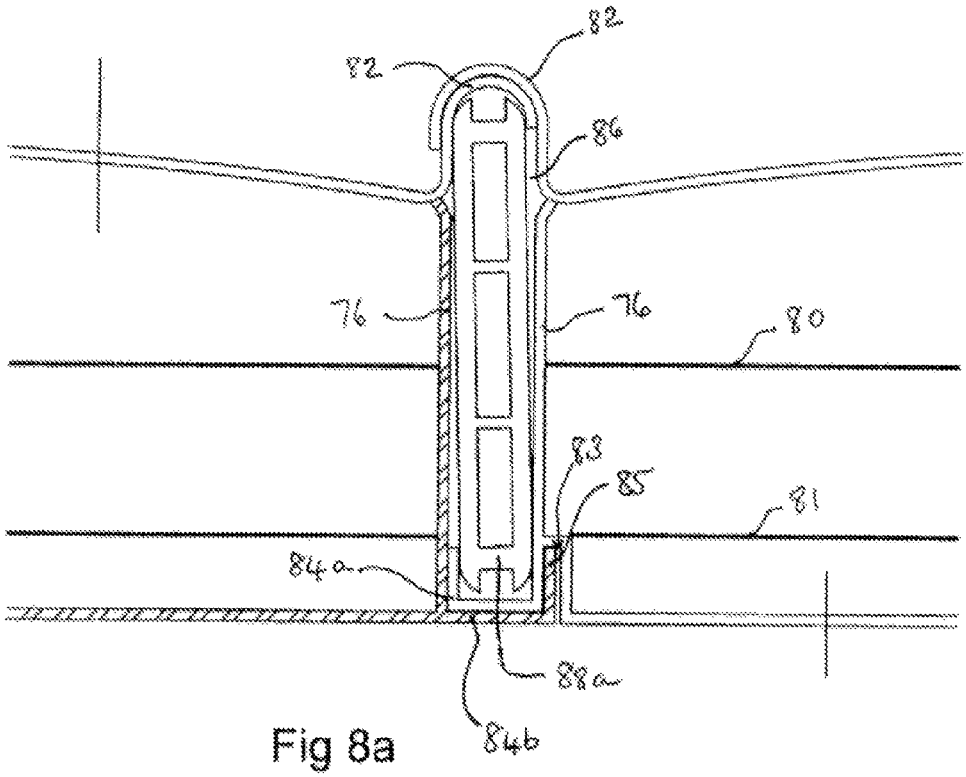
FIG. 8(*a*) is a section view showing a first embodiment of the manner of joining adjacent panels of FIG. 7*a* or 7*b* together side by side.
Figure 8B:
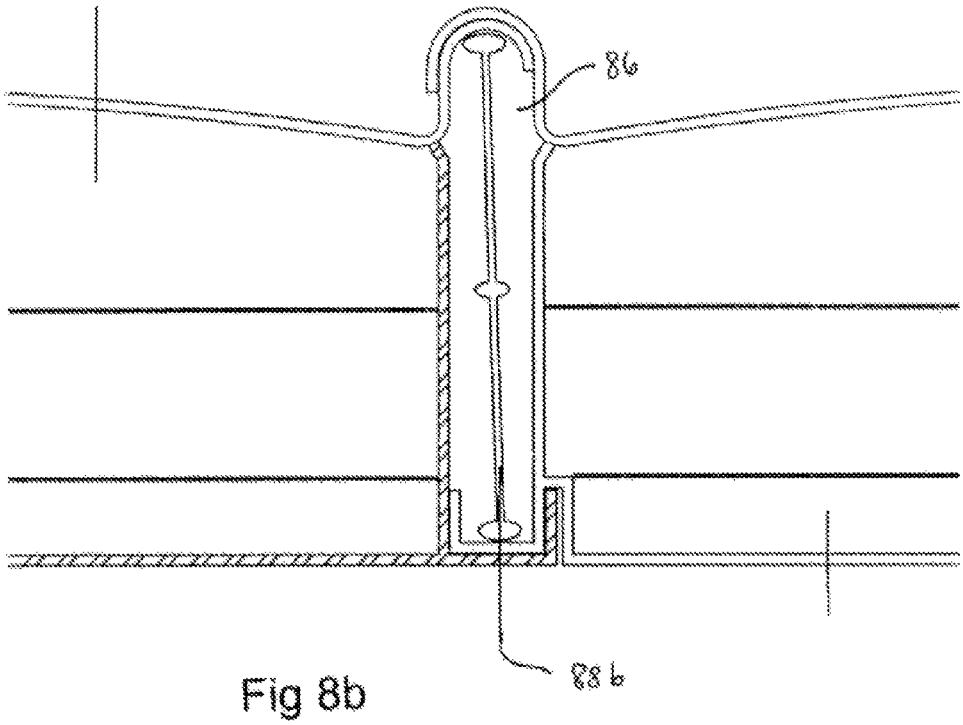
Figure 9:
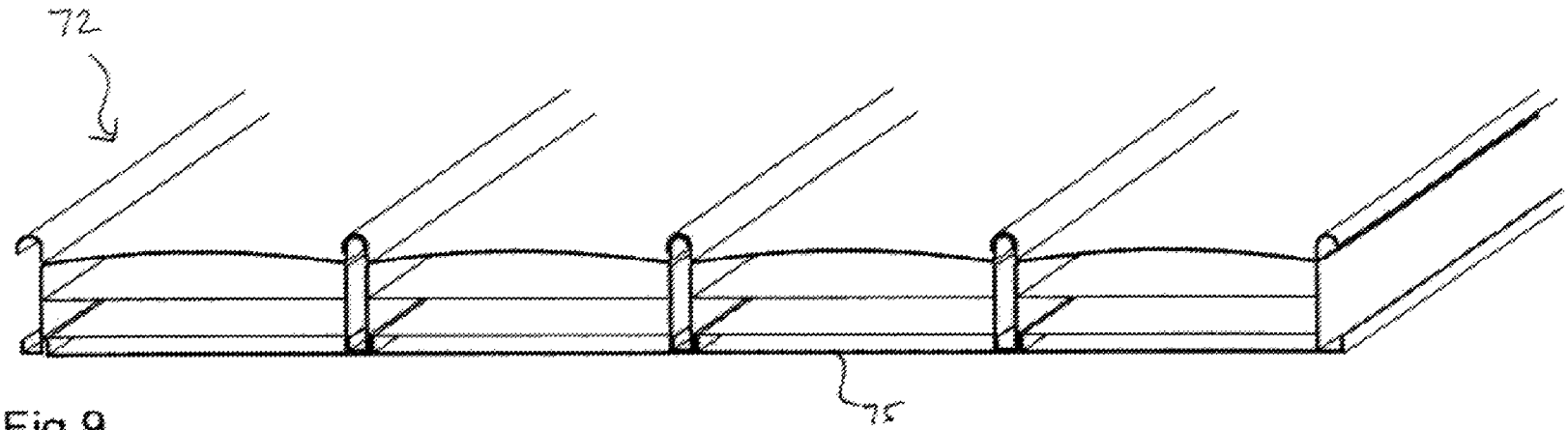
FIG. 9 is a top perspective view of a plurality of the panels of FIG. 7*a* joined side by side.

A second preferred embodiment of a building panel 70 as shown in FIGS. 7*a* and 8 to 10 comprises a hollow elongate structure 72 having a generally rectangular cross-sectional profile as can be seen most clearly in FIGS. 7*a* and 9. A third embodiment of a building panel 110 is shown in FIG. 7*b*. The second and third embodiments resemble the first embodiment in many respects, and will therefore not be described again in detail.

The elongate structure 72 comprises first and second outer skins 74 and 75 joined by substantially parallel first and second side walls 76*a* and 76*b*. The first outer skin 74 (upper outer skin) of the elongate structure 72 preferably has a degree of outward curvature in profile so as to form a convex outer upper surface. However the degree of curvature of the outer upper surface in the case of the second (and third) embodiments is somewhat less than in the case of the first embodiment, as can be seen by a comparison of FIGS. 4 and 9. The first outer upper skin 74 in the case of the second embodiment is almost planar as can best be seen in FIG. 9. Also the second outer lower skin 75 is substantially planar in the second and third embodiments.

The panel 70 further comprises connecting means 78 provided on each side wall 76 respectively wherein, in use, adjacent panels 70 can be connected to each other side by side with the connecting means 78 to form a segment of a wall or roof, as shown in FIG. 9. Each connecting means 78 comprises a first rib 82 and a second rib 84. The left first rib 82*a* is adapted to engage with a matching right first rib 82*b* on an adjacent panel in a nested arrangement. The first ribs 82 each have a curved profile and are arranged with concave surfaces facing the respective second ribs 84.

The left second rib 84*a* is adapted to engage with a corresponding right second rib 84*b* on the adjacent panel in a nested arrangement (see FIGS. 8*a* and 8*b*). The left and right second ribs 84*a* and 84*b* are both shaped so as to form respective rectangular channels along either side of the elongate structure 72. The left second rib 84*a* is of narrower width than that of the right second rib 84*b*, so as to be capable of being received in a nested arrangement within the right second rib 84*b*. The left second rib 84*a* is also formed with a narrow channel or recess 83 adjacent thereto which is adapted to accommodate an outer wall 85 of the right second rib 84*b* when neighboring panels are connected, as shown in FIGS. 8*a* and 8*b*. Thus when the left second rib 84*a* is received in the right second rib 84*b* the outer wall 85 is received in the recess 83 to provide an interlocking relationship.

As can be seen in FIGS. 7*a*, 7*b* and 9, the second ribs 84*a* and 84*b* do not protrude below the second outer skin 75 (as in the case with the corresponding second ribs 22*b* of the first embodiment). Instead the lower wall of the rectangular-shaped ribs 84 is substantially aligned with the planar second lower outer skin 75. In this way the lower surface of the panel 70 forms one continuous planar surface which has the benefit of being aesthetically pleasing providing a smooth contemporary seamless look. The continuous planar lower surface on the underside of the panel 70 is also much easier to clean than the discontinuous lower surface of the first embodiment, the latter as best seen in FIG. 4. The interlocking relationship between the left and right second ribs 84 also increases the structural strength of the overall panel system. In addition, the interlocking arrangement assists in dispersing rainwater and excess water may not easily pass inside the elongate structure.

As in the case of the first embodiment, the nested engagement of the ribs 82 and 84 together with the respective side walls 76 of the adjacent panels 70 form an enclosed cavity 86 between the adjacent panels, as can be seen in FIGS. 8*a* and 8*b*. An elongate locking member 88*a* or 88*b* is received in the enclosed cavity 86 to lock the ribs 82 and 84 into nested engagement with each other. The locking members 88*a* and 88*b* are as shown in the first embodiment and are typically formed of extruded aluminum and extruded polycarbonate respectively.

Figure 10:
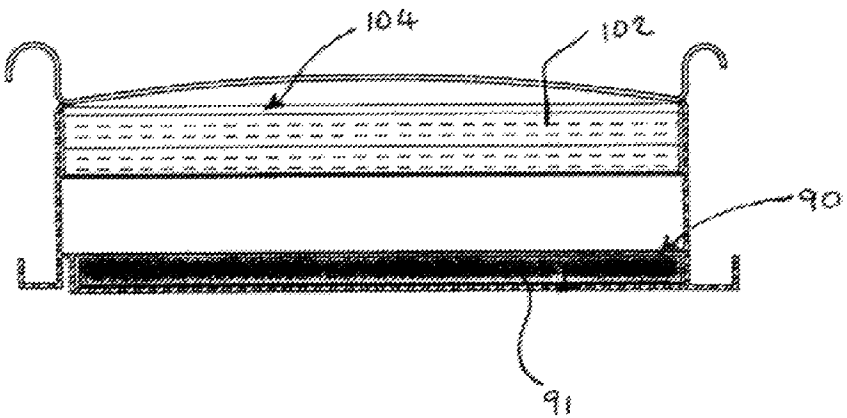
FIG. 10 is a front view of a panel of FIG. 7*a;*

The elongate structure 72 of the second embodiment further comprises two inner skins in the form of a first web 80 and a second web 81, both extending between the first and second side walls 76 so as to divide the interior of the elongate structure into three chambers. The triple chamber profile of the elongate structure 72 provides the panel 70 with additional structural strength and rigidity, as well as improved thermal and sound insulation properties, relative to the panel of the first embodiment. The lower chamber 90 allows for the accommodation of an additional clear solid polycarbonate sheet 91 to be fitted into the chamber 90 as shown in FIG. 10. The polycarbonate sheet 91 can be inserted during the manufacturing process in order to further increase the thermal performance and improve sound absorption, making the panel 70 of the second embodiment suitable for top end commercial projects. In addition, an insulating material 102 may be inserted in the upper chamber 104 to enhance the thermal performance of the panel.

Figure 11A:
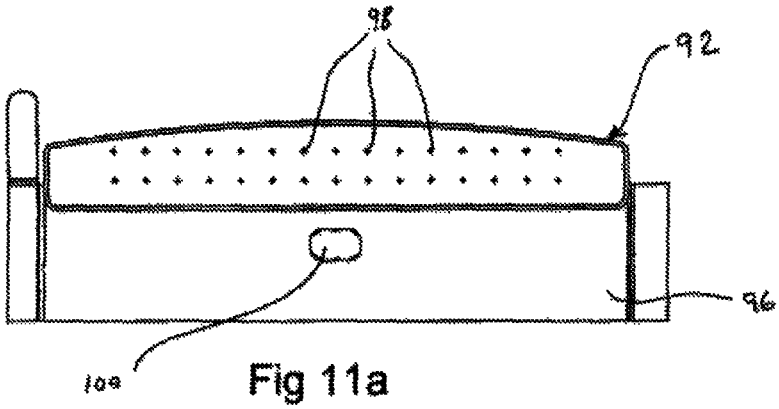
FIGS. 11(*a*), (*b*), (c) and (d) are front, rear, perspective and side views respectively of an end cap suitable for fixing to the panel of FIG. 7*a*.
Figure 11B:
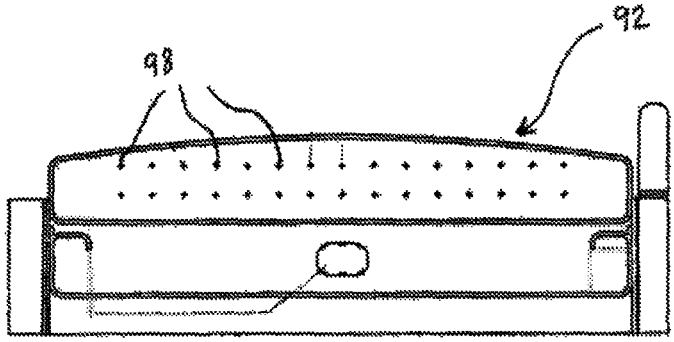
Figure 11C:
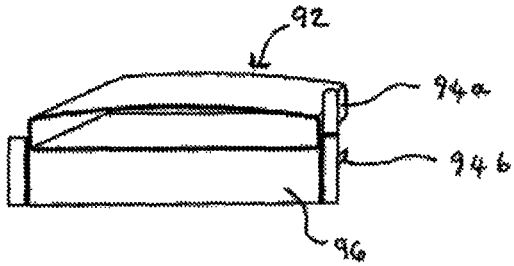
Figure 11D:
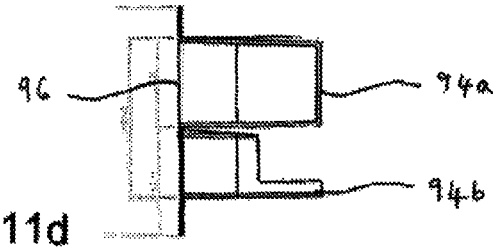

Preferably the building panel 70 further comprises an end cap 92 adapted to be received in the hollow end of the elongate structure 72. Advantageously the end cap 92 has first and second spigot pieces 94*a* and 94*b* adapted to be received in the chambers of the hollow elongate structure 72. As can be seen most clearly in FIG. 11*c*, the end cap 92 has a planar front face 96, on the back of which the spigot pieces 94 are formed. The end cap 92 is also provided with an array of holes 98 designed to assist air flow and to prevent build up of condensation within the panel. Typically there are 15 holes spaced evenly apart in two rows. In addition the end cap 92 is provided with an aperture 100 of dimensions about 16×10 mm which is used in barrel vault roof applications. The aperture 100 is typically covered with a removable tab such that the tab can be removed and access gained to the aperture, for example for insertion of a suitable bolt.

The third embodiment of a building panel 110 illustrated in FIG. 7*b* resembles the second embodiment in many ways and will not be described again in detail. As with the second embodiment, the panel 110 is provided with connecting means 114 on the respective side walls of the elongate structure and the interior is divided into three chambers 116. In the case of the second embodiment, the width of each panel is about 212 mm and in the case of the third embodiment the panel width is around 114 mm.

Now that preferred embodiments of the building panel and building system have been described in detail, it will be apparent that the embodiments provide a number of advantages over the prior art, including the following:

(1) It has superior span capabilities of up to 12 m curved and 4.38 m flat.
(2) It is fully trafficable; workmen can walk on it during installation.
(3) It can be supplied flat or curved in one complete span up to 15 m long.
(4) It facilitates rapid installation. 600 mm bay six panel configurations are supplied prefabricated and need only be joined every 600 mm on site.
(5) It is a lightweight, high impact strength product. Each bay can be easily lifted and locked into place manually on site.
(6) Each segment is identical to the next to give total conformability.
(7) It provides superior thermal performance and sound reduction.
(8) It is silicone free. No possible leakage where product is sealed. The unique connecting system as well as sealed joint allows for thermal moment without compromising thermal performance.
(9) Being translucent it maximizes natural light without excessive glare.
(10) It has a self-cleaning dome shape.
(11) Curved roof segments can be pre-curved in the oven during the manufacturing process.
(12) Being a tailor-made product means less wastage on site.
(13) The panel of the second and third embodiments presents a smooth uniform lower surface which is visually attractive and easy to clean.
(14) The interlocking relationship of the ribs increases the structural strength of the panel system and assists in dispersing rainwater.

It will be readily apparent to persons skilled in the relevant arts that various modifications and improvements may be made to the foregoing embodiments, in addition to those already described, without departing from the basic inventive concepts of the present invention. For example, the connecting means may take the form of suitable fasteners for connecting the panels side by side. Therefore, it will be appreciated that the scope of the invention is not limited to the specific embodiments described.

The claims defining the invention are as follows:

1. A polycarbonate building panel for the construction industry, the panel comprising:

a hollow elongate structure having a generally rectangular cross-sectional profile, the elongate structure comprising a first upper outer skin and a second substantially planar lower outer skin joined by first and second side walls;

a connection device provided on each side wall respectively wherein, in use, adjacent panels can be connected to each other side by side with the connection devices to form a segment of a wall or roof, wherein the connection devices each comprise a first rib and a second rib, the first rib being adapted to engage with a matching rib on an adjacent panel and the second rib also being adapted to engage with a matching rib on the adjacent panel, and wherein the second rib on each side wall has a rectangular profile with a lower wall and an outer wall forming an upwardly open channel, the second rib on the first side wall being formed with a recess immediately adjacent thereto between the channel and the hollow elongate structure, the recess being downwardly open and adapted to receive an outer wall of the second rib on the second side wall of an adjacent panel therein so that the channel of the second rib on the first side wall of an adjacent panel is received in a nested arrangement within the channel of the second rib on the second side wall of the panel to provide an interlocking relationship, and wherein the lower wall of the second rib on the second side wall is substantially aligned with the lower outer skin of the elongate structure so as to form a substantially seamless planar lower surface of the panel when adjacent panels are connected; and, an elongate locking member is provided to lock the first and second ribs into engagement with the matching ribs on an adjacent panel wherein, in use, adjacent panels are locked together to form a segment of a wall or roof.

2. A polycarbonate building panel as defined in claim 1, wherein the upper outer skin of the elongate structure has a degree of outward curvature in profile so as to form a convex outer surface.

3. A polycarbonate building panel as defined in claim 1, wherein the first and second side walls are substantially parallel and wherein the second rib on the first side wall is of narrower width than that of the second rib on the second side wall so as to be capable of being received in the nested arrangement within the channel of the second rib on the second side wall.

4. A polycarbonate building panel as defined in claim 3, wherein the first and second side walls are substantially planar.

5. A polycarbonate building panel as defined in claim 1, wherein the elongate structure comprises a third inner skin in the form of a web extending between the first and second side walls so as to divide the interior of the elongate structure into two chambers.

6. A polycarbonate building panel as defined in claim 5, wherein the elongate structure comprises a fourth inner skin in the form of a web extending between the first and second side walls so as to divide the interior of the elongate structure into three chambers.

7. A polycarbonate building panel as defined in claim 5, wherein one or more of the chambers is filled with additional materials to enhance the structural strength and/or thermal and/or sound insulation properties of the panel.

8. A polycarbonate building panel as defined in claim 1, wherein the matching ribs on an adjacent panel have a matching profile and are received in a nested engagement with the respective first and second ribs when adjacent panels are connected to each other side by side with the connection devices.

9. A polycarbonate building panel as defined in claim 8, wherein the nested engagement of the ribs together with the respective side walls of the adjacent panels form an enclosed chamber between the adjacent panels.

10. A polycarbonate building panel as defined in claim 9, wherein the elongate locking member is received in the enclosed chamber to lock the ribs into nested engagement with each other wherein, in use, adjacent panels are locked together to form a segment of a wall or roof.

11. A polycarbonate building panel as defined in claim 1, wherein the outer skins and side walls of the elongate structure are between 1 mm to 2.5 mm thick.

12. A polycarbonate building panel as defined in claim 11, wherein the upper outer skin is between 1.2 mm to 2.0 mm thick.

13. A polycarbonate building panel as defined in claim 12, wherein the lower outer skin is between 1.4 mm to 1.8 mm thick.

14. A polycarbonate building panel as defined in claim 1, wherein the upper outer skin has a UV resistant layer applied to it.

15. A polycarbonate building panel as defined in claim 14, wherein the UV resistant layer has a minimum thickness of 0.050 mm.

16. A polycarbonate building panel as defined in claim 1, wherein the total thickness of the polycarbonate panel is between 50 mm to 80 mm.

17. A polycarbonate building panel as defined in claim 16, wherein the total thickness of the polycarbonate panel is between 73 mm to 76 mm.

18. A polycarbonate building panel as defined in claim 17, wherein the polycarbonate panel is about 74 mm thick.

19. A polycarbonate building panel as defined in claim 1, wherein the total width of the polycarbonate panel is between 80 mm to 120 mm.

20. A polycarbonate building panel as defined in claim 19, wherein the total width of the polycarbonate panel is between 95 mm to 110 mm.

21. A polycarbonate building panel as defined in claim 20, wherein the polycarbonate panel is about 100 mm wide.

22. A polycarbonate building panel as defined in claim 1, wherein the elongate structure is substantially planar.

23. A polycarbonate building panel as defined in claim 1, wherein the elongate structure is formed with a degree of longitudinal curvature to give the panel increased load-bearing capacity.

24. A polycarbonate building system for the construction industry, the system comprising:

a plurality of polycarbonate building panels, each panel comprising:

a hollow elongate structure having a generally rectangular cross-sectional profile, the elongate structure comprising a first upper outer skin and a second substantially planar lower outer skin joined by first and second side walls;

a connection device provided on each side wall respectively wherein, in use, adjacent panels can be connected to each other side by side with the connection devices to form a segment of a wall or roof, wherein the connection devices each comprise a first rib and a second rib, the first rib being adapted to engage with a matching rib on an adjacent panel and the second rib also being adapted to engage with a matching rib on the adjacent panel, and wherein the second rib on each side wall has a rectangular profile with a lower wall and an outer wall forming an upwardly open channel, the second rib on the first side wall being formed with a recess immediately adjacent thereto between the channel and the hollow elongate structure, the recess being downwardly_open and adapted to receive an outer wall of the second rib on the second side wall of an adjacent panel therein so that the channel of the second rib on the first side wall of an adjacent panel is received in a nested arrangement within the channel of the second rib on the second side wall of the panel to provide an interlocking relationship, and wherein the lower wall of the second rib on the second side wall is substantially aligned with the lower outer skin of the elongate structure so as to form a substantially seamless planar lower surface of the panel when adjacent panels are connected; and, a plurality of elongate locking members configured to lock the first and second ribs into engagement with the matching ribs on adjacent panels wherein, in use, the plurality of panels can be joined to each other side by side with the connection devices and locked together to form a segment of a wall or roof.

25. A polycarbonate building system as defined in claim 24, wherein each locking member is in the form of an extruded aluminum bar.

26. A polycarbonate building system as defined in claim 24, wherein each locking member is in the form of an extruded polycarbonate bar.

27. A polycarbonate building system as defined in claim 24, further comprising an end cap adapted to be received in the hollow end of the elongate structure.

28. A polycarbonate building system as defined in claim 27, wherein the end cap has first and second spigot pieces adapted to be received in two chambers of the hollow elongate structure.

* * * * *